United States Patent [19]

Harris et al.

[11] Patent Number: 4,946,110

[45] Date of Patent: Aug. 7, 1990

[54] LAMINAR SEGMENTS FOR USE WITH COMMINUTION EQUIPMENT

[75] Inventors: Terrance R. Harris, Pulaski, Tenn.; Darrell R. Larsen, Salt Lake City, Utah

[73] Assignee: American Magotteaux Corporation, Nashville, Tenn.

[21] Appl. No.: 295,740

[22] Filed: Jan. 20, 1989

[51] Int. Cl.[5] ..... B02C 13/282; B02C 17/22

[52] U.S. Cl. ..... 241/182; 241/275; 241/299; 241/300

[58] Field of Search ..... 241/181, 182, 183, 264–269, 241/275, 299, 300

[56] References Cited

U.S. PATENT DOCUMENTS

| | | | |
|---|---|---|---|
| 1,309,807 | 7/1919 | Newhouse | 241/300 X |
| 2,275,992 | 3/1942 | Rahner | 241/183 |
| 2,465,607 | 3/1949 | Roubal | 241/182 X |
| 3,353,758 | 11/1967 | Whaley et al. | 241/300 |
| 3,844,492 | 10/1974 | Edwards et al. | 241/182 |
| 3,893,634 | 7/1975 | Schmidt | 241/182 |
| 4,018,393 | 4/1977 | Larsen | 241/182 |
| 4,046,326 | 9/1977 | Larsen | 241/182 |
| 4,165,041 | 8/1979 | Larsen | 241/182 |
| 4,181,266 | 1/1980 | Georgit et al. | 241/300 X |
| 4,235,386 | 11/1980 | Larsen | 241/183 |
| 4,270,705 | 6/1981 | Larsen | 241/183 |
| 4,319,719 | 3/1982 | Larsen | 241/183 |
| 4,559,986 | 12/1985 | Svensson et al. | 241/182 X |
| 4,717,083 | 1/1988 | Quast et al. | 241/197 |

OTHER PUBLICATIONS

Intermountain Minerals Symposium, Selected papers from the sessions on "Materials for Mining" presented at the Eighteenth Annual AIME International Minerals Conference, Vail, Colo., (Aug. 3–6, 1982).

The Hazemag Impact Crusher—Its Design, Operation and Field of Application (date unknown).

*Primary Examiner*—Timothy V. Eley

*Attorney, Agent, or Firm*—Workman, Nydegger & Jensen

[57] ABSTRACT

A novel laminar assembly for use with comminution equipment, such as a liner for protecting the shell of an ore crushing mill or as a wear tip on a blow bar for use in a rock impact crusher. The laminar segment includes a plurality of laminae which are attached to each other with a rod extending through holes positioned in the base of the laminae, thereby forming a segment of virtually any desired length. Mounting bolts are configured in two pieces, with an axial hole extending through the head of the mounting bolt by which they are mounted to the rod and thereby attached to the liner segment. A second piece of the mounting bolt threadably engages the head of the bolt and extends through the mounting surface of the comminution equipment being used. The utilization of small laminae enable the laminae to be cast and heat treated such that the microstructure throughout the laminae may be strictly controlled, thereby providing a laminae with consistent hardness and toughness throughout the laminae.

36 Claims, 5 Drawing Sheets

LAMINAR SEGMENTS FOR USE WITH COMMINUTION EQUIPMENT

BACKGROUND

1. Field of the Invention

The present invention relates to methods and apparatus for providing a protective lining and impacting surface for equipment used in ore and rock comminution. More particularly, the present invention relates to a new and improved liner assembly and mounting apparatus for providing the shell of an ore grinding mill with a liner having desired metallurgical properties.

2. The Background of the Invention

In commercial mining operations, large autogenous and semi-autogenous mills are often employed to comminute ore removed from the mine. Such mills include a large drum, having a typical diameter of 28 feet and a length of 12 feet. In operation, ore is fed through a trunnion into the feed end of the drum while the drum is being rotated about a central axis. As the drum rotates, the ore is comminuted by being subjected to both continuous-pressure and impact mechanisms. The ore is then removed from the opposite, or discharge end of the mill.

These autogenous and semi-autogenous mills are typically intended for continuous operation. However, because ores being comminuted in the mill may be hard and highly abrasive, the drum will quickly wear out unless some provision is made to protect the drum from wear while the mill is in operation. Replacing the drum not only would cause a serious disruption in the operation of the mill, but would result in such a significant expense that the use of such a mill would be impractical.

The universally accepted solution for protecting the drum from wear is to employ a liner which may be mounted onto the cylindrical sections of the drum, or the "shell" of the mill. In recognition of this necessity to include a liner, when the drums are manufactured, a series of rows of mounting holes are drilled into the shell of the mill. A series of liner segments may then be mounted onto the shell of the mill utilizing these mounting holes, thereby virtually completely covering the shell of the mill. These mounting holes are typically spaced in the axial direction (i.e., along the axis of rotation of the mill) approximately 12 to 24 inches apart.

After a period of use, the liner segments are worn to the point that they must be replaced. In order to reduce to a minimum the amount of down time of the mill associated with the replacement of liner, liner design has been directed towards facilitating rapid replacement of the liner.

It takes virtually the same amount of time to replace a large liner segment as it takes to replace a small liner segment. Thus, the trend in liner design has been to make liner segments as large as possible, resulting in fewer liner segments to replace. For example, by doubling the size of the liner segments, the number of liner segments which must be replaced is reduced by half. This results in a corresponding reduction in time required to replace the liner.

Because of the weight of the liner segments, special equipment is employed to lift the segments and place them in position for mounting to the shell of the mill. This "liner handler" is always used to support the liner segments during mounting. Thus, the increased weight associated with employing larger liner segments results in a negligible increase in the difficulty of replacing the liner.

In addition to being advantageous to mill operators in reducing the amount of down time of the mill during replacement, large liners also represent a significant economic advantage over smaller liners to liner manufacturers. A significant factor in determining the price which is charged for such liners is their weight. Liners are usually priced by charging a predetermined amount per pound of material.

Because such liners are made by casting, a liner manufacturer may double the poundage of sellable material produced in one mold simply by doubling the size of the liner. It is not uncommon to produce a liner with one casting which results in several thousand pounds of material which is ready to sell. As is the case when installing the liner, casting amount of work involved. Thus, when producing liners having half the size, twice as much work is involved by the manufacturer to produce the same dollar volume of product.

Because of the enormous size and weight of most ore grinding mills, the size limit of steel plate which is available, the capacity of metal forming machines, and the transportation limitations which arise when dealing with such machinery, it is necessary to manufacture the mills in several sections which may be assembled at the mill site. The mills are typically made of cylindrical quadrants having flanges extending from their perimeter for mounting to one another. By representative example, when constructing the mill, the cylindrical quadrants are mounted lengthwise to each other to form a cylinder. Several cylinders may be mounted to each other to achieve the desired length of mill. End pieces may then be mounted to the ends of the cylinder to enclose the mill The joints along the circumference of the drum represent the weakest structural points in the drum. To compensate for this weakness, liners mounted inside the drum may be mounted such that they span these joints and are secured to the drum on both sides of the joints. Such a liner, therefore, serves a dual purpose; it provides a hard material used in comminuting the ore and it reinforces the structure of the drum, thereby lending stability to the mill.

From the foregoing, it can be seen that significant economic forces have dictated that the size of liners employed to protect the shell of the mill be as large as possible. Additionally, the use of large liners has been preferred because their size enables the liners to be used to reinforce the joints of the cylindrical quadrants which are mounted together to form the mill.

Replaceable impact surfaces found in other comminution equipment also tend to be large for many of the same reasons as described above. For example, the blow bar used in a rock impact crusher is preferably made of one piece, thereby keeping to a minimum the time involved to replace the blow bar. Additionally, manufacturing of the blow bar is facilitated if only one casting must be performed to produce the blow bar.

The use of large impact surfaces, however, does present various difficulties. For example, mill shell liners are preferably made of a material which is highly abrasion resistant in order to withstand virtually continuous contact with hard and highly abrasive ores. Additionally, the liner must be impact resistant so that it does not rapidly disintegrate due to brittle failure during operation of the mill.

Because the liner must have a high hardness, it is not feasible to machine the liner segments. Use of a material which would be machinable with conventional equipment would necessarily require use of a material which would not have sufficient hardness for use as a liner. Thus, manufacturing liner segments of a castable material is the only economically viable method of manufacture.

Although the properties of hardness and toughness are, to a large extent, exclusive of each other, a suitable combination of hardness and toughness may be obtained by heat treating the liner. An example of a material ideally suited for this application would be martensitic white iron or martensitic steel.

High hardness is obtained in the liner segment through heat treatment. After the liner segment has been cast, it is heated and allowed to "soak" at a given temperature for a period of time, thereby forming austenite. Following the austenite formation, the segment is rapidly cooled, or "quenched," to form martensite. The quenching must occur fast enough to avoid transformation to pearlite or bainite.

The primary difficulty which arises when attempting to quench a large casting to form a martensitic microstructure throughout the liner segment is that because of the thickness of the liner the rate of heat loss may not be sufficient to avoid transformation to another microstructure. This frequently results in the formation of a martensitic microstructure at the surface of the casting with other, softer microstructures being formed at the core. Additionally, the slower rate of solidification associated with the larger casting will produce a product having a larger grain size than a smaller casting, thereby adversely affecting the hardness of the final product.

One of the hazards of rapid quenching is the possibility of distorting and cracking the liner segment. As the surface portions of the liner segment pass through the martensite transformation, they will initially expand as the temperature in that portion of the liner drops and martensite is formed. The remainder of the liner is still austenite, soft and hot, and follows the expansion. Then, as the rest of the liner passes through the martensite transformation and the associated expansion, the surface portions of the liner, which are hard, brittle martensite, will frequently crack.

The manufacturing process must, therefore, be carefully monitored to ensure that the temperature gradient within the liner segments stays within acceptable limits, thereby avoiding cracking of the liner segments during quenching. Even though the liner segments may not crack, uneven quenching may set up residual stresses within the liner segments which will decrease liner life. These difficulties associated with the production of liner segments having a martensitic microstructure obviously increase the cost of manufacture of such liner segments.

Thus, one of the primary disadvantages associated with the production of martensitic liner segments is that it is difficult to obtain the same degree of hardness in the core of the liner segment as at the surface. In operation, once the hard surface of the liner becomes worn, the remainder of the liner, which does not enjoy the same degree of hardness as the surface, will quickly wear. This obviously decreases the operational time of the mill between replacement of liners.

Another feature which adds to the difficulty of casting the liner segments is that bolt holes must be provided in the segments through which a bolt may be inserted to mount the liner segments to the mill shell. When preparing a mold which will cast a liner having a hole in it, an insert must be provided in the mold to form the hole. As the liquid metal is poured into the mold, it forms swirls and curls around the insert which results in a weak zone at that location. When the part fails, it usually fails at the hole.

In recognition of the weak zone which exists at the hole in the liner, most liners are designed such that the hole is not in the primary wear section of the liner. The liner is provided with a recessed area which includes the hole. The disadvantage with this configuration is that the wear section, or portion of the liner exposed to the ore stream, must necessarily be smaller to provide for the recessed portion containing the hole.

Attempts made to attach the mounting bolt to the liner thereby eliminating the through hole have failed because of problems associated with removing the liners. A typical liner segment may be mounted to the shell of the mill with several bolts. If an attempt is made to remove the liner without first removing the bolts, the liner will bind because of the difficulty of evenly pulling the liner bolts out of the holes in the shell of the mill.

Thus, the usual practice for removing a liner segment is to first remove at least all but one of the bolts by removing the nut on the outside of the shell and pushing the bolt through the hole in the liner. The liner segment may then be broken loose and removed without any binding.

One proposed solution to the manufacturing problems encountered when attempting to produce a large liner segment having a hardness sufficient for use in a mill is to include one or more alloys in the casting. It is generally recognized that alloys may be used to produce a material having desired mechanical properties when the physical parameters of the casting prevent the material from being heat treated to attain those properties. Increasing the amount of alloys in the casting enables a liner having a coarser grain size to be produced with the same hardness as a non-alloyed material having a finer grain. Thus, alloys permit the successful hardening of many complex designs that could not otherwise be produced.

However, a serious disadvantage to the use of a substantial amount of alloys is their high cost. Although alloys may enable a desired hardness to be achieved in a complex design, the increased cost associated with the use of alloys may render the use of such alloyed liners impractical for many applications.

Another means employed by the prior art to achieve a liner assembly having a hard surface is to use a composite liner assembly. A composite liner is a liner assembly which employs a tough material for the primary structure of the liner coupled with one or more inserts or segments formed from a highly abrasion-resistant material which comprises a secondary structure. The tough primary structure is attached to the hard secondary structure in such a manner that the hard inserts or segments are exposed directly to the ore fragments.

Composite liner assemblies are designed primarily for use in rod mills where there is no point contact. In ball mills and autogenous mills where there is a substantial amount of point contact with the liners, composite liners are not effective because the hard inserts only cover approximately 30 percent of the surface area of the shell of the mill.

Another disadvantage to such composite liner assemblies is that they are geometrically complex and utilize complicated mounting mechanisms. Thus, composite liner assemblies are frequently expensive to manufacture and, because of their many parts, are difficult to install. Additionally, when the hard secondary material eventually breaks away due to its brittleness, the hard inserts or segments must immediately be replaced before the primary structure is irreparably damaged by the abrasive action of the ore.

Because the primary structure serves no purpose other than as a mounting mechanism for the hard secondary structure, it adds weight to the already heavy mill without providing a corresponding increase in crushing efficiency.

It will be appreciated, therefore, that what is needed in the art are methods and apparatus for covering the shell of an ore grinding mill with a liner which may be easily and inexpensively installed and replaced.

It would be a further enhancement in the art if such liners could be manufactured such that the microstructure of the liner could be controlled during heat treatment, thereby producing a liner having the same microstructure throughout (such as a martensitic microstructure) and substantially the same grain size throughout.

Indeed, it would be yet a further advancement in the art if such a liner could be heat treated during the manufacturing process such that the risks of breaking the liner and establishing significant residual stresses within the liner are substantially eliminated.

It would be an additional enhancement in the art if such liners could be provided with a mounting mechanism which eliminate the necessity for through holes in the liner, thereby avoiding weak zones in the wear section of the liner.

It would also be an advancement in the art if such a liner could be manufactured without employing significant amounts of expensive alloys.

It would be an additional advancement in the art if such liners could be manufactured without employing a composite liner assembly having a tough material as a primary structure and hard material for a secondary structure, thereby eliminating the complex, intricate configurations associated with such liner assemblies and providing a liner assembly having a lower weight than such composite liner assemblies.

Such methods and apparatus are disclosed and claimed herein.

BRIEF SUMMARY AND OBJECTS OF THE INVENTION

The present invention includes novel methods and apparatus for providing an impacting surface for use in comminution equipment such as a liner for the shell of an ore grinding mill. According to the present invention, a plurality of thin laminae are provided and configured such that they can be mounted together to form one substantially integral liner segment. The liner segment also employs novel liner bolts which mount the liner segment to the shell of the mill.

Each of the laminae is configured with a mounting channel in one side of the base of the lamina. When two laminae are placed together such that the mounting channels are in communication with each other, the mounting channels combine to form a pocket into which the head of a liner bolt will fit.

Each of the laminae is configured with a hole which passes through the base of the laminae. The head of each liner bolt is also configured with a hole. The holes in the laminae and the head of the liner bolts are aligned such that when several laminae are placed together with liner bolts occasionally located in the pockets which are formed, a high-strength rod may be inserted through the laminae and the liner bolts. According to this unique mounting mechanism, no holes are necessary in the wear section of the laminae.

A nut may then be placed on the end of the rod and tightened to rigidly mount the laminae to each other. The rod also serves to attach the liner bolts to the laminae. The resulting liner segment may then be mounted to the shell of an ore grinding mill.

When tightening the nut on the bolt to rigidly mount together the laminae, it is preferred that the laminae all be aligned with each other. To assist in aligning the laminae during assembly, a recess and tab are cast into each lamina. The recess and tab are configured such that they form a mating connection when the laminae are stacked together. With the recess and tab of adjacent laminae in mating connection with each other, the laminae are substantially prevented from movement with respect to each other while the liner segments are being assembled.

The recess on one face of the lamina is in the same position as the tab on the opposite face of the same lamina. Additionally the laminae are configured such that each face is identical with respect to the positioning of the recess and the tab. This enables just one mold to be used in casting the laminae of the present invention. To preserve the ability to use one mold in manufacturing the laminae, it is preferred that the mounting channel be configured on the same side of each lamina.

The laminae may also be cast to include a chamber into which may be placed a lifting hook. When installing or removing the liners the lifting hook is engaged by the liner handler to grasp the liner segment. As with the mounting channel which accommodates the head of the liner bolt, the chamber for the lifting hook may be cast on the same side of each laminae thereby enabling only one mold to be used when forming the laminae.

The use of a plurality of small laminae to form an integral liner segment has tremendous metallurgical consequences. Because of the small size of the casting which produces the laminae, the temperature gradients within the laminae during heat treatment are substantially reduced. This enables the laminae to be heat treated to form virtually any type of microstructure which may be desirable for a given application.

Because of the low temperature gradient upon cooling, the laminae will be formed with essentially the same microstructure throughout; that is, the microstructure at the core of the laminae will be equivalent to that at the surface. The ability to exercise control over the microstructure of the laminae obviates the necessity of heavily alloying the laminae to compensate for the failure to obtain the desired abrasion-resistance and impact-resistant characteristics through heat treatment, such as frequently occurs in a conventional liner segment.

The laminae may be rapidly quenched without the danger of cracking the laminae or forming residual stresses in the laminae. Additionally, because of the rapid cooling rate associated with the laminae, the laminae may be quenched with blast air, thereby avoiding the use of more expensive quenching mediums. A significant advantage to the use of the liner segments of the present invention is the fact that a martensitic microstructure, which only forms upon rapid quenching, may be formed throughout the laminae of the present invention by quenching with blast air.

The present invention also includes a novel liner bolt which, as intimated previously, eliminates the necessity of incorporating through holes in the wear sections of the liner segments. The liner bolt comprises two sections which threadably engage each other—an interior and an exterior section.

The interior section includes the head of the bolt and is mounted to the liner segment with the high-strength rod as described above. The exterior section of the liner bolt is configured to threadably engage the interior section of the liner bolt such that the resulting bolt has substantially the same length as a conventional liner bolt. The exterior section is also configured with threads such that when the bolt is inserted through a mounting hole in the shell of the mill, a nut may be threaded on the end of the bolt and tightened against the wall of the mill thereby placing the bolt in tension.

When preparing to replace the liners in a mill, a sufficient number of liner segments must initially be assembled. The liner segments may be assembled to have virtually any length desired. As mentioned previously, there is a savings in labor when longer liner segments are used because the actual number of liner segments which must be mounted to the wall of the shell is reduced. Liner segments of five to six feet in length are not uncommon.

Thus, in assembling the liner segments, laminae are "stacked" together with the recess and tab of abutting faces in mating connection. A number of liner bolts may then be inserted, where needed, in the pockets which are formed by the laminae. The rod is then placed through the hole running through the base of the laminae and the head of the liner bolts and a nut threaded on the end of the rod.

Before tightening the nut on the rod, a number of lifting hooks may be placed in the liner segment by inserting them in the chamber which has been cast in the laminae. By tightening the nut, the laminae are rigidly mounted to each other and a substantially integral liner segment is formed. The liner bolts and the lifting hooks also become connected to the liner segment upon tightening of the nut.

To obtain a sufficiently tight mount, it may be desirable to heat the rod before inserting it through the laminae and tightening the nut on the end. By manually tightening the nut on the rod while the rod is hot, it is possible to take advantage of thermal expansion and contraction to achieve a tighter mount. As the rod cools, it will contract to its original size thereby applying an even greater compressive force to hold the laminae together.

The spacing of the mounting holes in the shell of the mill may vary from mill to mill. Thus, when assembling the liner segments, it is only necessary to place a liner bolt in those pockets in the liner segments which correspond in position to the mounting holes in the shell of the mill. It may be preferable not to include a liner bolt for every mounting hole, depending on how firmly the liner must be mounted to the shell of the mill.

When mounting liner segments made according to prior art designs, the liner is brought into the mill with the liner handler and held against the shell of the mill for mounting. These prior art liner segments are configured with holes extending completely through the liner segment through which a liner bolt may be inserted. Thus, when the liner is placed against the shell, a worker may insert a liner bolt through the hole in the shell and the hole in the liner.

As mentioned previously, the existence of "through holes" in the liner is disadvantageous because it weakens the liner and usually results in a more complex liner casting because of efforts to keep the through holes away from the primary wear surfaces of the liner. Additionally, eliminating through holes in the liner gives rise to problems when mounting the liner.

For example, rigidly mounting the liner bolt to the liner segment, thereby eliminating the through hole in the liner segment, has been one proposed solution. However, in order to mount such a liner segment to the shell of the mill, all the liner bolts must simultaneously be inserted through the mounting holes in the shell of the mill. Because this is accomplished from the inside of the mill, it is difficult to see the mounting holes because the view of the holes is obstructed by the liner segment. By employing the novel mounting assembly of the present invention, the problems associated with these "blind" holes may be remedied.

According to one embodiment of the present invention, a conventional liner bolt (as modified with a hole in the head of the bolt) is employed in each liner segment, as will be explained below in greater detail. Thus, all other liner bolts attached to the segment are two-piece liner bolts, configured according to the present invention.

The interior section of the two-piece liner bolts includes a threaded male member. The exterior section is configured with a corresponding threaded female member. The outside of the exterior section is also threaded, thereby enabling a bolt to be screwed onto the exterior section and cinched against the shell of the mill.

When installing a liner segment, the segment is brought through the trunnion of the mill with the assistance of the liner handler. The segment is then placed in alignment with the mounting holes in the shell of the mill and the single conventional liner bolt is inserted through the mounting hole in the shell of the mill, thereby refining the alignment of the liner segment with respect to the mounting holes.

Workers located on the outside of the mill may then insert exterior sections of liner bolts through the mounting holes in the shell and thread them onto the corresponding interior sections. After the exterior sections of liner bolts have all been fully threaded onto the inside sections, a washer and nut may be placed on the exterior sections and tightened. As the nut is tightened, it draws the liner bolt out of the hole such that the liner segment becomes rigidly seated against the inside of the mill.

In an alternative embodiment of the present invention, the liner bolt may include a stud segment which is included in the pocket between adjacent laminae. The stud segment is provided with a hole which aligns with the hole in the laminae through which the rod is inserted to attach the laminae together. Also, the stud segment is threaded at its base. Thus, when mounting the liner segments, a threaded rod may be inserted from the outside of the mill through the hole in the shell of the mill and threaded directly into the stud segment.

On some mills, a liner plate is employed between the liner segment and the shell of the mill. The liner plate is typically made of a material which has high impact resistance. Thus, the liner plate protects the shell while the liner segments provide a hard surface against which the ore may be comminuted.

The liner plate may employ a variety of configurations which are conventional in the art. However, regardless of the geometry of the liner plate, the base of the liner segment may be configured such that when it is mounted to the shell of the mill it seats firmly against the liner plate.

When the liner segments become worn and need replacement, the first step in the removal process is to break loose the nuts on the exterior section of the liner bolts. When attempting to break the nuts loose, it is not uncommon for the exterior section of the liner bolt to break loose from the interior section. To the extent this occurs, the removal process is facilitated because after the nuts have been removed from the exterior sections of the liner bolts, the exterior sections must be broken loose from the interior sections and removed.

When the exterior sections of the two-piece liner bolts have all been removed, only the one-piece, conventional liner bolt will remain protruding through the shell of the mill. The liner may then be broken away from the shell and/or the liner plate by applying an impact force on the remaining liner bolt from the outside of the mill. The worn liner segment may then be removed from the mill and a new liner segment put in its place.

It is, therefore, a primary object of the present invention to provide methods and apparatus for protecting the shell of an ore grinding mill with a liner assembly which may be easily and inexpensively installed and replaced.

It is also an object of the present invention to provide such methods and apparatus such that the microstructure of the liner assembly may be controlled during manufacture while substantially eliminating the danger that the liner will crack or develop internal stresses during quenching.

It is a further object of the present invention to provide such methods and apparatus such that through holes may be eliminated from the wear section of the liner assembly while allowing the liner to be removed from the mill without binding.

It is an additional object of the present invention to provide such methods and apparatus which employ a segmented liner having sufficient metallurgical properties such that the use of expensive alloys may be substantially avoided.

Other objects and advantages of the present invention will become apparent upon reading the following detailed description and appended claims, and upon reference to the accompanying drawings.

DETAILED DESCRIPTION OF THE PREFERRED EMBODIMENTS

Figure 1:
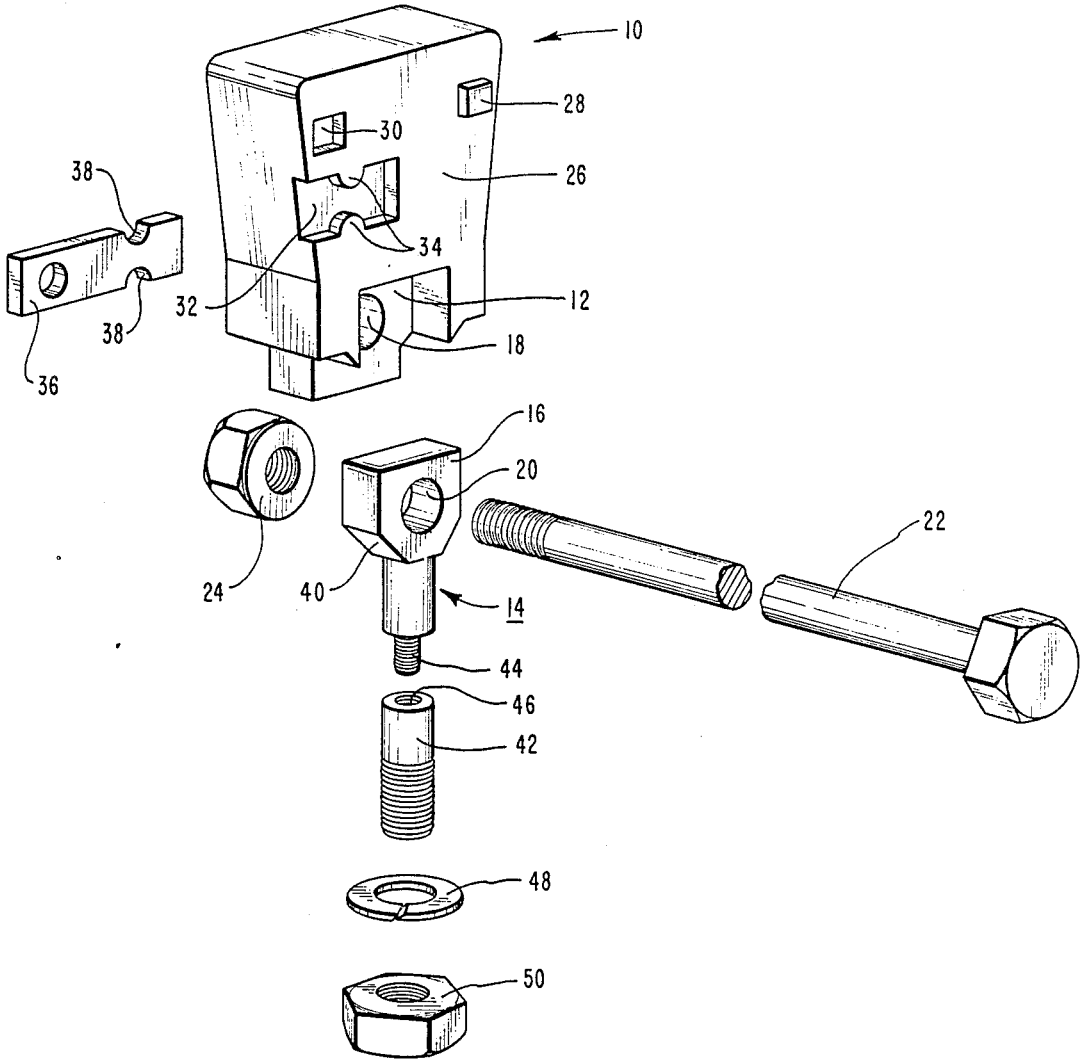
FIG. 1 is an exploded perspective view of one lamina and one two-piece mounting bolt according to the present invention.

Reference is now made to the drawings wherein like parts are designated with like numerals throughout. The present invention is directed to methods and apparatus for lining the shell of an ore grinding mill. Referring now to FIG. 1, a lamina according to the present invention is designated at 10. Lamina 10 includes a mounting channel 12 which is configured to receive a liner bolt 14.

Liner bolt 14 includes a polygonal head 16. Thus, mounting channel 12 is configured such that approximately half of head 16 of liner bolt 14 fits within mounting channel 12. Mounting channel 12 is further configured with a hole 18 and as head 16 of the liner bolt is configured with a corresponding hole 20. Thus, when head 16 of the liner bolt is received in mounting channel 12, hole 18 and hole 20 are aligned. Although liner bolt 14 is illustrated with a polygonal head 16, it will be appreciated that liner bolts having heads of a variety of geometries may be employed according to the present invention. However, it is more difficult to drill a hole through the head of the bolt if there is not a flat surface against which to start drilling the hole.

When forming a liner segment according to the present invention, a plurality of laminae 10 are placed adjacent each other and a rod 22 is placed through the extended hole formed when each hole 18 and hole 20 are aligned. A rod nut 24 may then be threaded on the end of rod 22 to fasten the plurality of laminae together, as is explained in further detail below. Rod 22 is preferably made of a high-strength alloy steel. It is important that the rod be strong because if the rod fails, the laminae will become disassembled.

Lamina 10 includes a face 26 on which is configured a tab 28 and a recess 30. The opposite side of face 26 (not shown) includes a tab corresponding in position to recess 30 and a recess corresponding in position to tab 28. Thus, when a plurality of laminae are placed in alignment with one another by placing the faces of the laminae together, the tab on one lamina will engage the recess on the adjacent lamina in mating connection. Because each connection includes two tab/recess connections, the laminae are prevented from movement relative to each other because of the mating connection of the tabs and recesses.

Lamina 10 is further configured with a chamber 32 which includes two keyed sections 34. Chamber 32 is designed such that a lifting hook 36 may be placed in chamber 32 when a liner section according to the present invention is assembled. Thus, lifting hook 36 includes two keyways 38 which engage keyed sections 34 when lifting hook 36 is placed in chamber 32.

In a presently preferred embodiment of the invention, chamber 32 is cast in only one face of each lamina. Thus, when two laminae are placed together in mating connection, there is not a corresponding chamber in the face of the adjacent lamina which aligns with chamber 32. Accordingly, chamber 32 is cast to have the same thickness as lifting hook 36.

It can be observed by reference to FIG. 1 that only one mold is necessary for casting the laminae employed by the present invention. Thus, when assembling a liner segment, a lamina identical to lamina 10 will be aligned with liner 10 such that the mounting channels are in communication with each other. Face 26 must therefore be configured such that tab 28 and recess 30 are in symmetrical positions with respect to each other.

With continued reference to FIG. 1, liner bolt 14 includes an interior section 40 and an exterior section 42. Interior section 40 includes a threaded male member 44 at its base. Threaded male member 44 corresponds to a threaded female member 46 configured in exterior section 42. Thus, male member 44 and female member 46 are configured such that they may threadably engage each other. As will be pointed out in greater detail below, the use of a two-piece liner bolt, as illustrated in FIG. 1, greatly facilitates installation and removal of the liner segments.

A washer 48 and a mounting nut 50 are also provided for use on exterior section 42 of liner bolt 14. When used to mount a liner segment to the shell of a mill, washer 48 and mounting nut 50 are placed on liner bolt 14 from the outside of the mill and tightened against the shell of the mill to provide a firm mount of the liner segment.

Figure 2:
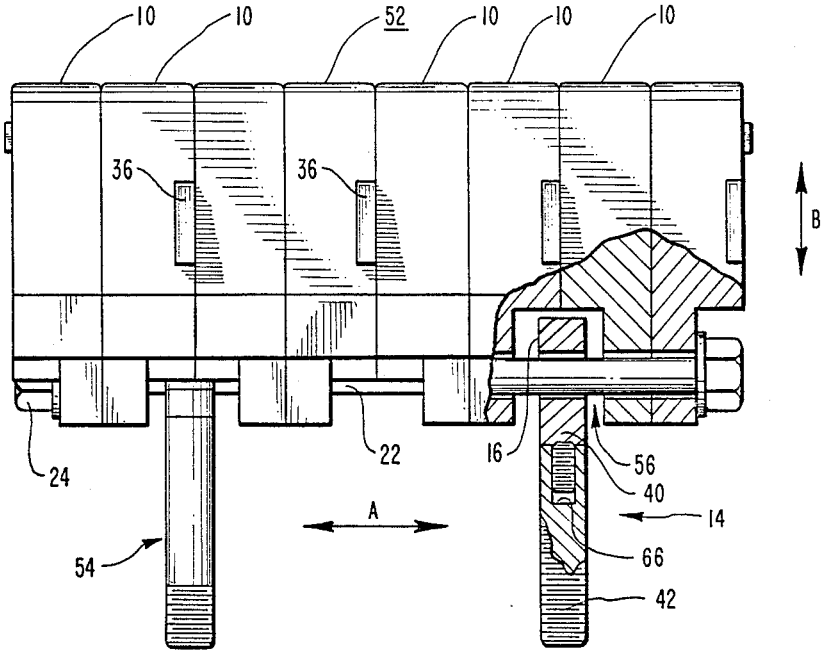
FIG. 2 is a side view of a liner segment illustrated with one conventional liner bolt and one two-piece liner bolt, with portions of the laminae broken away to more clearly illustrate the relationship between the laminae and the liner bolts.

Referring now to FIG. 2, a liner segment according to the present invention is illustrated. In FIG. 2, a plurality of laminae 10 are illustrated in interconnection to form a liner segment 52. Liner segment 52 is illustrated with two liner bolts—a two-piece liner bolt 14 and a conventional liner bolt 54.

When mounted in an ore grinding mill, the liner segments are mounted on the shell of the mill in the "axial" direction —parallel to the axis of rotation of the mill. Thus, as used herein, the "axial" direction refers to the direction parallel to the axis of rotation of the mill, or along the direction of arrow A in FIG. 2.

It will be appreciated by one skilled in the art that the apparatus and methods of the present invention may also be used to provide liners configured for mounting along the walls of the feed cone and the discharge cone, as well as other areas in the mill in which liners are employed. Although such liners are not always mounted parallel to the axis of rotation of the mill, "axial direction," as used herein, shall refer to the direction of the length of the liner segments, as indicated by arrow A.

When mounted on the shell of the mill, the liner bolts are directed in the "radial" direction —the direction extending outwardly from the axis of rotation of the mill in a plane perpendicular to that axis. Accordingly, the "radial direction," as used herein, refers to that dimension of the liner segment indicated by arrow B in FIG. 2.

Figure 3:
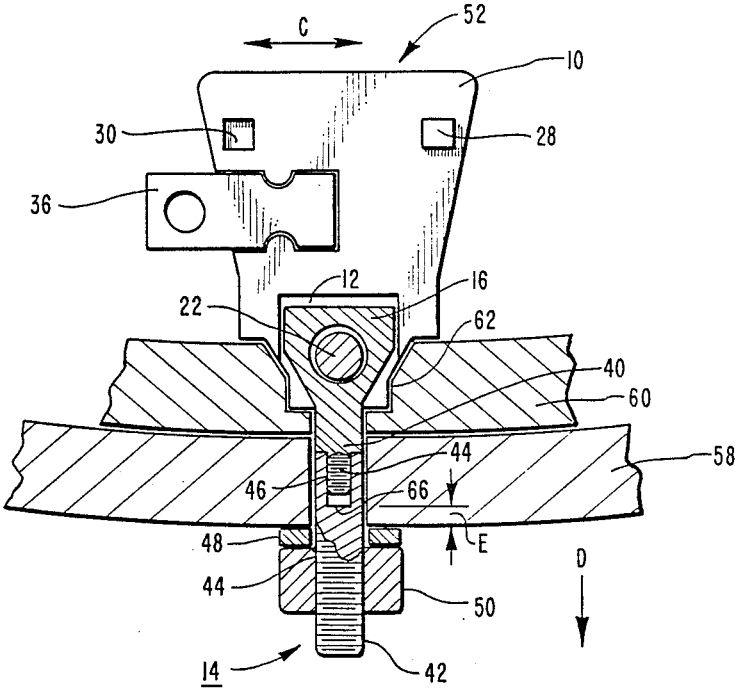
FIG. 3 is a cross-sectional view of a liner segment mounted to the shell of an ore grinding mill.

Finally, as used herein, the "transverse" direction refers to the direction parallel to a line tangent to the shell of the mill at a right angle to the axis of rotation of the mill. The "transverse" direction, as used to refer to a dimension of a liner segment, is indicated in FIG. 3 by arrow C.

As can be noted by reference to FIGS. 1 and 2, liner segment 52 comprises a plurality of laminae whose smallest dimension is in the axial direction. Whereas the prior art liners usually have their largest dimension in the axial dimension. As noted above, prior art liners with lengths of five and six feet are not uncommon.

When manufacturing liners for use in an ore grinding mill, it is desirable to cast and heat treat the liners such that substantially the same microstructure is developed throughout the liner. That is, the microstructure in the core of the liner is the same microstructure as on the surface of the liner. As used herein, "heat treating" also encompasses conventionally known methods of forging.

However, some microstructures are particularly difficult to obtain when high temperature gradients exist in a material upon quenching. If the core temperature of a material cannot be reduced at a sufficiently fast rate, the desired microstructure will not be developed.

For example, when manufacturing liners for use on the shell of an autogenous mill, it is preferred that the liner have an optimum combination of abrasion resistance and impact resistance. Thus, a liner which is both tough and hard is ideal for use in such an application.

It has been found that an acceptable combination of hardness and toughness can be achieved by employing a liner having a martensitic microstructure. A martensitic microstructure, however, can only be achieved upon rapid quenching. Indeed, the hardenability of the liner segment may be limited by the cooling rate which may be realized in the segment. Thus, many liners cannot be made with a martensitic microstructure throughout the liner because they are so large that rapid quenching, particularly at the core of the liner segment, may not be obtained.

If the desired microstructure cannot be achieved through heat treating, resort must be made to the addition of extra alloys to increase hardenability and thereby provide the liner with sufficient hardness and toughness. Alloys, of course, may add significantly to the cost of the liner. Thus, if a while maintaining a low level of alloying elements.

The ability to quench rapidly is therefore the key to maintaining control over the microstructure of the liner. Frequently the physical limitations on a particular product prevent that product from successfully being subject to rapid quenching. Whether a particular product can be rapidly quenched can be visualized as a function of how far the heat must travel from the core of the product to the surface. Thus, the greater the minimum distance from the innermost core of the product to the surface, the higher the temperature gradient during quenching will be for a given cooling medium.

Without changing the material out of which the product is made, the temperature gradient may be decreased by simply altering the configuration of the product such that the distance from the core of the product to the surface is reduced. With respect to mill liners, it has heretofore been perceived as impossible to substantially alter the distance from the core of the liner to the surface.

As mentioned previously, substantial economic forces have dictated that the length (axial direction) of liners be maximized. The height (radial direction) and width (transverse direction) of liners has also needed to be maximized to provide a sufficient wear section in the liner, thereby maximizing the life of the liner and resulting in a corresponding reduction in down time of the mill.

The "wear section" of the liner is that portion of the liner which is directly exposed to impact forces from the ore or other media in the mill to assist in the comminution of the ore. After the wear section of the liner has been worn out, the liner must be replaced. Thus, when designing liners, primary importance must be given to the metallurgical properties of the wear section of the liner.

By incorporating a laminar design, the present invention provides a lamina which may be assembled with other laminae to present virtually any axial length of liner segment. Thus, virtually any cross-sectional shape (perpendicular to the axial direction as viewed in FIG. 3) may be employed while maintaining the ability to control the microstructure of the laminae during casting and heat treating. This control may be maintained because the rate of quenching is no longer tied to those cross-sectional dimensions (transverse and radial).

The laminae of the present invention may therefore be manufactured having a selected microstructure throughout the laminae, which microstructure could not be otherwise achievable in unitary large castings. Preferred materials for use in manufacturing the laminae of the present invention include both irons (carbon content greater than approximately 1.25 percent) and steels (carbon content between approximately 0.3 and 0.7 percent). More particularly, high-chromium white irons having a carbon content from approximately 2.5 to approximately 3.0 percent also provide an ideal material from which to manufacture laminae according to the present invention.

Of course, it is impossible to obtain the exact same metallurgical properties at the core of a product as at the surface. To do so would require that there be absolutely no temperature gradient in the material upon quenching; which is impossible. However, for commercial purposes, the temperature gradient in the laminae of the present invention does approach uniformity sufficiently to make the microstructure of the laminar essentially uniform.

Thus, as used herein, when a part is said to have "substantially the same metallurgical microstructure throughout," it is meant to comprise a generally equivalent grain size and/or microstructure character; when considering the application for which the liners of the present invention are intended; recognizing that quality control and natural properties and impurities of materials will result in some deviation between core and surface. The same is true as applied to "grain size" or other properties, such as hardness and toughness.

The microstructure is made essentially equivalent by sizing the axial length of each lamina such that the temperature gradient is more uniform during cooling. The center of the core is that interior location of the lamina which is farthest from all cooling surfaces. In FIG. 3, the center of the core is approximately midway along the axial length and essentially equidistant between the top of lamina 10 and the top of mounting channel 12. In selecting conditions conducive to microstructures which are equivalent throughout the liner, an axial dimension which is small compared to the transverse and radial dimensions is most advantageous. Thus, the center of the core is closer to the faces 26 during cooling than it is to other surfaces.

Generally speaking, the closer the center of the core is to a surface, the more favorable the conditions are for achieving a microstructure which is equivalent throughout the liner. In the present invention, the distance from the center of the core along the axial length of each lamina should be less than the distance from the center of the core to the surface in the radial or transverse direction.

After the laminae according to the present invention have been formed with the desired properties, they are combined to form a liner segment which may be configured with liner bolts and mounted to the shell of the mill.

The spacing between liner bolts is primarily a function of the mounting hole pattern in the mill in which the liner segment is being installed. Typical spacing of mounting holes in the shell of the mill ranges from 12 to 24 inches. When the liner segment is assembled, the liner bolts may be placed in the liner segment such that they correspond to the hole pattern in the mill. Thus, the liner segments of the present invention may easily be configured to fit virtually all conventional grinding mills.

When assembling liner segment 52, a sufficient number of laminae 10 are "stacked" together to form the length of liner segment which is desired. In one representative example, each lamina of FIG. 2 is approximately three inches in length. Significantly, the length is less than the radial or transverse dimensions. Thus, to form a 24 inch liner segment, eight laminae must be used. It will be appreciated that liner segments may be assembled having any length which is conventionally known for use in such ore grinding mills. The ability to assemble a variety of lengths of liners represents a significant advantage to liner manufacturers because it eliminates the need to maintain an inventory of each length of liner which might be requested.

When stacking the laminae together, they are placed such that the face of one lamina engages the identical face of each adjacent lamina. With the laminae so placed, the tab and recesses on adjacent laminae engage each other in mating connection, thereby preventing relative movement of the laminae. Also, mounting channels 12 of the lamina are in communication with each other thereby forming a pocket 56. The liner bolts may be attached to the liner segment by inserting the head of the liner bolt in the pocket 56 corresponding to the location along the liner segment where a liner bolt is desired.

With the laminae in stacked relation to each other such that the tab and recesses are in mating connection and liner bolts inserted in the desired pockets 56, rod 22 may be inserted through hole 18 in the base of each lamina and through hole 20 in the head of each liner bolt. By threading nut 24 on the end of rod 22, the liner segment may be rigidly secured to form an integral liner segment.

When assembling long liner segments, it may be difficult to tighten nut 24 on rod 22 as much as desired. Thus, when assembling long liner segments, it is preferred to heat rod 22 such that its length will increase due to thermal expansion. In the expanded state, rod 22 may be placed through the laminae and nut 24 tightened as much as possible. As rod 22 cools, it will attempt to contract to its original length thereby imparting a significant compressive force on the lamina to secure them together.

By reference to FIG. 3, the mounting mechanism according to the present invention is illustrated and may be explained. In FIG. 3, a liner segment of the present invention is shown in cross section, as mounted to a shell 58. Shell 58 is illustrated with a liner plate 60 providing a seat 62 into which the liner segment is mounted.

When installing liner segment 52, a liner handler is used to grasp liner segment 52 by lifting hook 36 and hold it up to the shell of the mill in the approximate location where it is desired to mount the liner segment.

At this point, conventional liner bolt 54 (FIG. 2), which is preferably included in each liner segment, may then be inserted through the hole in the shell of the mill which corresponds to liner bolt 54.

Workers located on the outside of the mill may then insert exterior section 42 of liner bolt 14 through mounting hole 64 in the shell of the mill. After exterior section 42 has been inserted through the shell of the mill, threaded female member 46 of exterior section 42 may be threaded onto threaded male member 44 of interior section 40 of line bolt 14. Thus, the workers on the outside of the mill can locate each liner bolt individually and connect the exterior and interior section of the liner bolt together.

By eliminating through holes in the liner, it is no longer possible to simply line up the holes and insert a bolt through the liner and the shell of the mill, such as is typically done when mounting liners having through holes. Without the two-piece liner bolts of the present invention, conventional liner bolts would have to be attached to the liner segments.

Thus, worker on the inside of the mill would be faced with the challenge of simultaneously aligning all of the liner bolts with their corresponding holes and holding that alignment while the liner is pushed against the shell, thereby inserting all the liner bolts through the holes for mounting. The problem of aligning the liner bolts with the mounting holes in the shell of the mill is further exacerbated by the fact the presence of the liner obstructs the view of the holes. These mounting problems which have previously prevented the elimination of through holes in the liner, are avoided by employing the mounting mechanism of the present invention.

Following the connection of exterior section 42 to interior section 40 to form an integral liner bolt, washer 48 and mounting nut 50 may be inserted on the end of exterior section 42 of the liner bolt. As mounting nut 50 is tightened, it pulls the entire liner bolt toward the exterior of the mill, in the direction of arrow D. The liner bolt acts on rod 22 which transfers this force in the direction of arrow D to the liner segment. Thus, as mounting nut 50 is tightened on liner bolt 14, each lamina 10 is seated against seat 62.

The shape of the base of lamina 10 is preferably configured to match the geometry of liner plate 60. It will be appreciated by one skilled in the art that a variety of liner plates may be employed in combination with the present invention. For example, some liner plates may permit the base of the lamina to rest against the inside wall of shell 58, with a portion of the lamina resting against a seat, similar in configuration to seat 62.

Although exterior section 42 of the liner bolt is illustrated as including female member 46 and interior section 40 of the liner bolt is illustrated as including male member 44, it will be appreciated that these configurations may be reversed. Thus, the advantage of the present invention are also realized with interior section 40 configured to include the threaded female member and exterior section 42 configured to include the threaded male member.

Additionally, exterior section 42 may also be configured as a cap screw without departing from the present invention. If a cap screw configuration is employed, care must be taken to ensure that the threaded female member is sufficiently long that the cap screw does not bottom out when tightened. If a cap screw is employed rather than the threaded rod/nut combination illustrated in FIG. 3, the liner segment is tightened against the mill shell by tightening the connection comprising the male and female members. This is in contrast to the configuration illustrated in FIG. 3 in which the mounting nut 50 is tightened to seat the liner segment against the shell only after the two pieces of the liner bolt have been secured to each other.

While such variations of the mounting mechanism, as discussed above, are contemplated as being within the scope of the present invention, it is presently preferred that the mounting mechanism be configured substantially as illustrated in FIG. 3.

With continued reference to FIG. 3, it will be observed that the bottom 66 of threaded female member 46 of liner bolt 14 does extends inwardly beyond the exterior surface of shell 58. Because liner bolt 14 is subjected to significant lateral forces resulting in shear stresses on liner bolt 14, it is preferred that the cross section of exterior section 42 of the liner bolt not include the threaded female member at the exterior wall of shell 58. By having a solid cross section at that point, the liner bolt is better able to withstand the forces applied to it while the mill is in operation. Thus, bottom 66 is preferably a distance E from the outside surface of the liner shell. In a preferred embodiment, distance E is approximately ¼ inch.

Several provisions are made by the present invention to account for the lack of precision in the tolerances of mounting holes in the mill shell. For example, as can be best viewed in FIG. 2, the liner bolts attached to liner segment 52 with rod 22 are capable of slight movement in the axial direction, i.e., along the line of arrow A. Thus, when installing the liner segment, if the mounting holes in the mill shell are not spaced within tight tolerances, the liner segment of the present invention is not precluded from being mounted to the shell.

As illustrated in FIG. 3, there is also a degree of movement between head 16 of the liner bolt and mounting channel 12 in the base of the laminae. This enables liner bolt 14 to have a sufficient degree of freedom that it may be directed into the mounting hole in the mill shell even though the spacing of those holes may not be within the tolerances anticipated by the liner manufacturer.

When the liners become worn, removal of the liners may be easily and quickly accomplished. With continued reference to FIG. 3, when it is necessary to remove the liners, mounting nut 50 may be broken loose and removed from each liner bolt 14. After each mounting nut 50 has been removed, each exterior section 42 may then be unscrewed from interior section 40 of the liner bolts. Advantageously, when employing a two-piece liner bolt, occasionally while attempting to break loose mounting nut 50, the threaded connection between interior section 40 and exterior section 42 of the liner bolt will come loose first.

With all of the mounting nuts and the exterior sections of the liner bolts removed, the liner section may then be broken loose by applying an impact force to conventional liner bolt 54. The worn liner segment may then be removed through the trunnion of the mill with the assistance of the liner handler. A new liner is then brought into the mill and mounted in its place, following the procedure substantially as described above.

Figure 4:
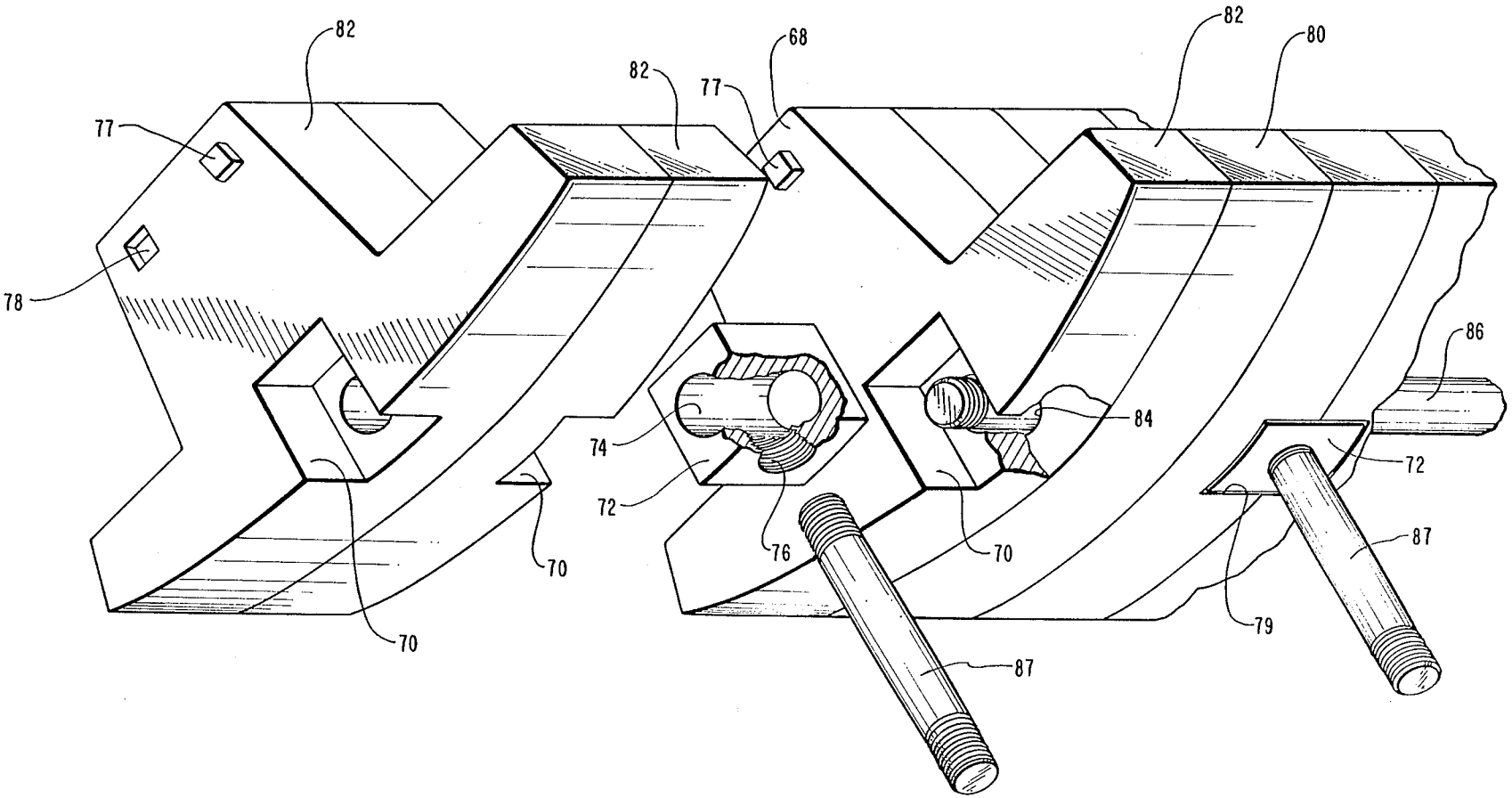
FIG. 4 is a partially exploded perspective view of an alternative embodiment of the two-piece mounting bolt according to the present invention, with portions of the stud anchor broken away to more particularly illustrate the configuration of the holes in the stud anchor.

An alternative embodiment of the liner bolt according to the present invention is illustrated in FIG. 4. A lamina 68 is configured with a mounting channel 70 substantially as previously described. A stud anchor 72 is employed within mounting channel 70 in the same manner as the head 16 of liner bolt 14 in FIG. 1 fits within mounting channel 12.

Each stud anchor 72 is configured with an axial hole 74 extending completely through the anchor in the axial direction. Additionally, each stud anchor includes a radial hole 76 extending upwardly from the bottom of each anchor. In a presently preferred embodiment of the invention, radial hole 76 extends upwardly a sufficient distance such that it is in open connection with axial hole 74, as illustrated in FIG. 4.

When employing stud anchors 72 to mount liner segments according to the present invention, a plurality of lamina are stacked together and aligned by means of tabs 77 and recesses 78. A stud anchor 72 is inserted in pocket 79 formed by the mating mounting channels 70 of the laminae.

Because it is only necessary to employ a stud anchor where a liner bolt will be used to mount the liner segment to the shell of the mill, laminae may be configured without mounting channel 70 where no stud anchor is used. Thus, "internal" laminae 80, configured without a mounting channel, may be employed in combination with "end-and-stud" laminae 82, configured with a mounting channel, to form the liner segment.

It will be noted that internal laminae 80 are also configured with an axial hole 84 in the base of each lamina through which a rod 86 may be inserted. Thus, in assembling the liner segment as illustrated in FIG. 4, a plurality of laminae are stacked together with end-and-stud laminae 82 employed where a liner bolt will be attached to the laminae and on the ends of the liner segment. Internal laminae are preferably used in all other locations and essentially act as fillers between the end-and-stud laminae.

When mounting a liner segment configured as shown in FIG. 4 to the mill shell, the liner segment is brought through the trunnion of the mill and held against the shell of the mill. Workers on the outside of the mill may then insert a threaded rod 87 through the mounting holes in the mill shell and thread the rod into axial hole 76 in stud anchor 72. A washer and nut may then be placed on the threaded rod on the outside of the mill shell and tightened, thereby securing the liner segment in place.

When removing the liner segment after it is worn, the nuts on the exterior of the mill shell are loosened from their corresponding threaded rods. The rods may then be unscrewed from the stud anchor and the liner segment broken loose and removed from the mill. It may be desirable to remove all but one rod from each liner segment and then apply an impact force to the remaining rod from the exterior of the mill to assist in breaking the liner segment loose.

It has been found that grinding efficiency is improved if an uneven surface is provided within the mill. To take advantage of this potential for increased efficiency, a mill may be lined with rows of liner segments which alternate in height For example, one row of liners may be approximately 9 inches high (in the radial direction) with alternating rows being approximately 18 inches high.

Some equipment used in producing laminae according to the present invention have size limitations which would prevent an 18 inch laminae from being produced in one piece. Thus, the present invention may be utilized to employ a two-tiered liner segment.

Figure 5:
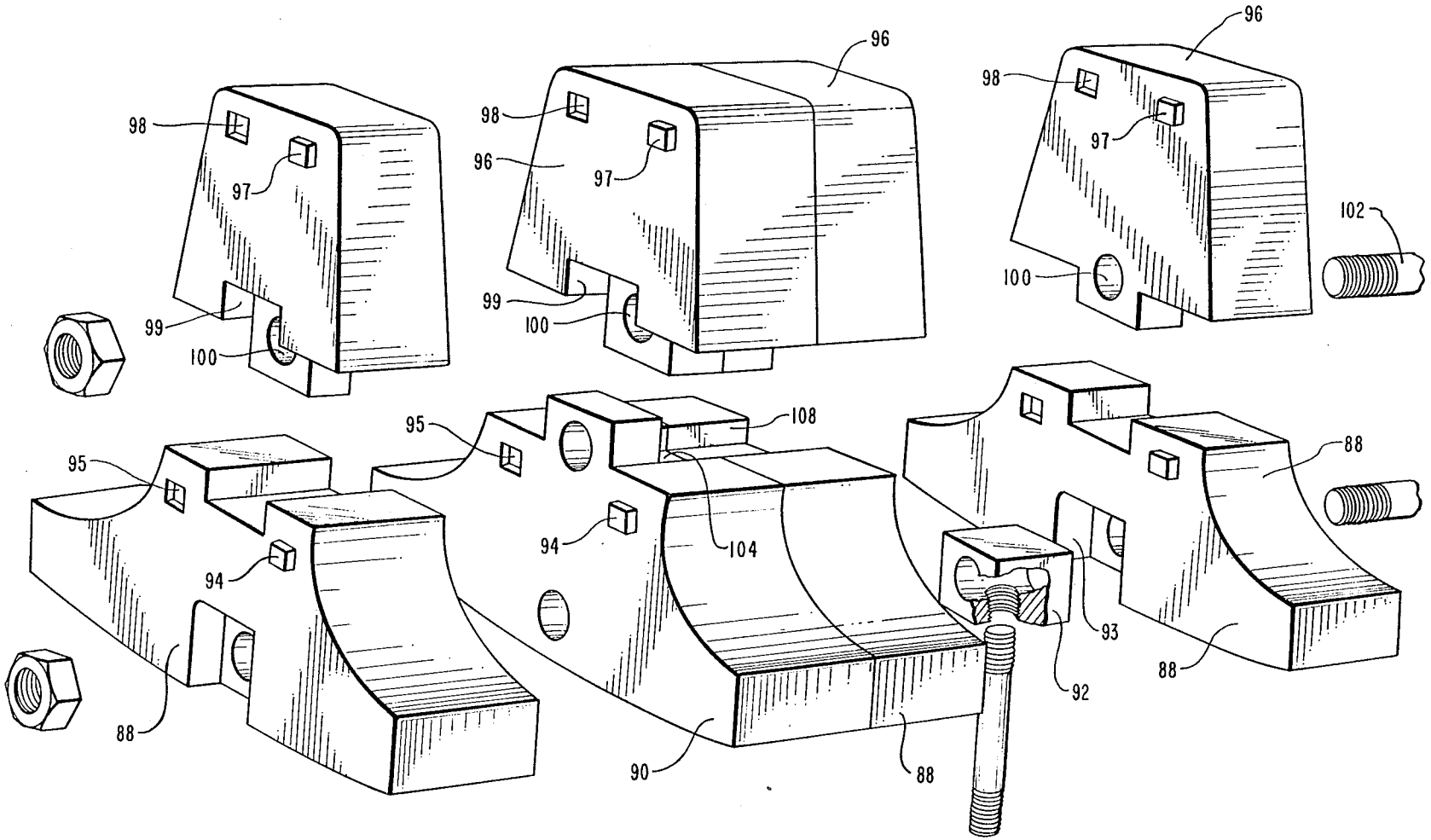
FIG. 5 is an exploded perspective view of a two-tiered liner segment according to the present invention.

In FIG. 5, such a two-tiered liner segment is illustrated. The two-tiered liner segment includes two end-and-stud laminae 88 corresponding to each liner bolt and one end-and-stud lamina at each end of the segment. A stud anchor 92 fits within the mounting channels 93 of two end-and-stud laminae which are stacked together such that their respective mounting channels are in mating connection, thereby enabling the liner segment to be mounted to the mill shell as described in connection with FIG. 4. When the laminae are stacked together, they are properly aligned by means of tab 94 and recess 95 configured on each laminae. Again, internal laminae 90 are preferably used as fillers between the end-and-stud laminae.

A top element 96 is provided for each laminae. Each top laminae 96 is configured with a tab 97 and recess 98 to aid in aligning the top elements during assembly of the liner segment. A mounting channel 99 and an axial hole 100 which are used in combination with a rod 102 to mount the top laminae to the internal and end-and-stud laminae. As can be seen by reference to FIG. 5, each internal laminae 90 also includes a top hole 106 and a top mounting channel 104 configured to form a mating connection with mounting channel 99 on top elements 96. Thus, rod 102 may be inserted through axial hole 100 on each top element 96 and through top hole 106 to form a substantially integral piece between top element 96 and internal lamina 90.

End-and-stud laminae 88 are configured with a channel 108 extending in the axial direction. When top element 96 is placed on an end lamina, the mounting channel of the top element is left open. Thus, the head or nut on the rod 102 extending through the top elements lies within the mounting channel and does not protrude beyond the end of the liner segment.

Because end-and-stud laminae 88 do not include a top mounting hole, the top elements corresponding to each end-and-stud laminae are not directly attached to the end-and-stud laminae. The top elements are, however, tied to the end-and-stud laminae indirectly through the adjacent top elements which are directly attached to internal laminae 90.

Figure 6:
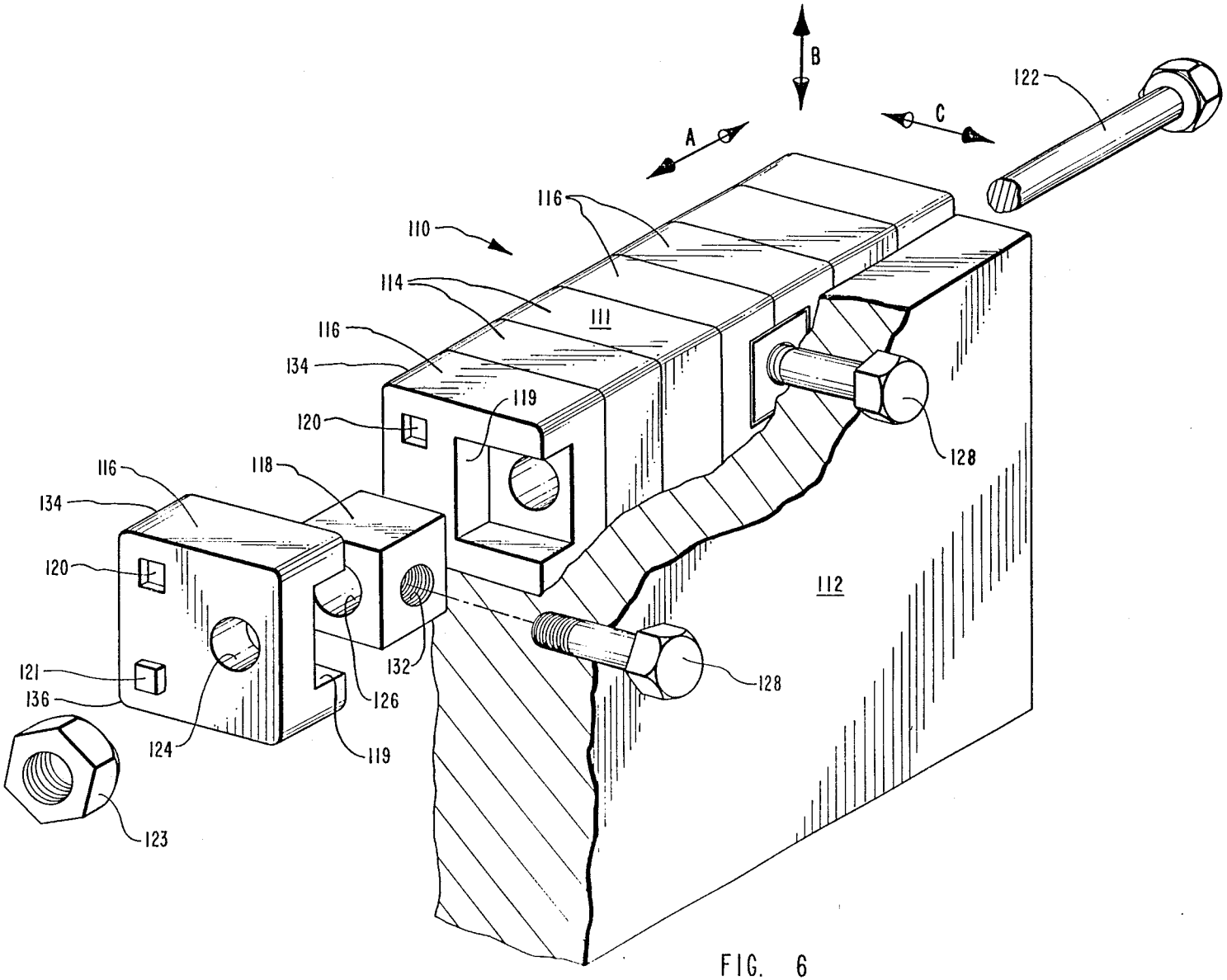
FIG. 6 is a partially exploded perspective view of the present invention as used on the blow bar of a rock impact crusher, with portions broken away to more particularly illustrate how the wear tip is mounted to the carrier bar.

Although the present invention has primarily been described with reference for use with an ore grinding mill, it will be appreciated by one of ordinary skill in the art that the present invention may be used in a variety of applications. For example, FIG. 6 illustrates the utilization of the present invention on a rock impact crusher. As with liners in ore grinding mills, blow bars on impact crushers are ideally constructed of a material having an optimum combination of hardness and toughness.

Blow bars are typically made in one-piece sections in order to facilitate removal and replacement. Also, blow bars can be manufactured more economically if they are cast as one section. Thus, as with liners for ore grinding mills, blow bar design has tended toward large one-piece sections. Because of the size of the sections, the ability to control the metallurgical properties of the blow bar by heat treating is restricted. However, by using the laminar design of the present invention, blow bars may be manufactured to have predetermined metallurgical characteristics obtained through heat treatment while providing a one-piece section for ease of installation.

Blow bars are attached to the rotor mechanically with bolts or in interlocking fit between the rotor and the blow bar. Approximately 50 percent of the weight of the blow bar is necessary to allow for attachment and this portion remains unworn throughout the effective life of the blow bar. The present invention may be used to provide a separate wear tip which is mounted to a carrier bar to form the blow bar. Having replaceable wear tips allows that portion of the blow bar which remains unworn to be reused. When utilizing the present invention to provide a wear tip on the blow bar, the wear tip is subject to wear while preserving and protecting the carrier bar. This significantly reduces the scrap out weight associated with the blow bar.

As illustrated in FIG. 6, a blow bar, generally designated at 110, includes a wear tip 111 attached to a carrier bar 112 according to the teachings of the present invention. The wear tip comprises a series of internal laminae 114 in combination with a series of end-and-stud laminae 116. A stud anchor 118 fits within the mounting channels 119 of the stud laminae 116.

Thus, two end-and-stud laminae are employed in mating connection wherever it is desired to locate a stud anchor. Additionally, an end-and-stud lamina is used at each end of the wear tip and oriented with mounting channel 119 facing outwardly such that the head of rod 122 and nut 123 which are used to attach together the laminae (as described below) rest within the mounting channel and do not protrude beyond the exterior face of the end laminae.

The laminae are attached together to form an integral wear tip by first stacking together laminae corresponding to the axial length of wear tip desired, where the axial direction is denoted by Arrow A. The laminae are then aligned by means of a mating tab 120 and recess 121 configured on each laminae, as previously described in connection with the mill liner segments. A rod 122 is then placed through axial holes 124 in the laminae and axial holes 126 in the stud anchors and affixed at its end by a nut 123.

Wear tip 111 is mounted to carrier bar 112 with mounting bolts 128 which extend through mounting holes in carrier bar 112 and are threaded into transverse holes 132 in the stud anchors. It will be appreciated that mounting bolt 128 may include a threaded rod, a cap screw or any other apparatus known in the art for mounting such pieces together, whether by threaded connection or otherwise.

In operation, the wear tip may be quickly and easily mounted or removed from the carrier bar by means of mounting bolts 128. Use of the present invention permits superior metallurgical qualities to be obtained in the wear tip of the blow bar which heretofore have not been available in the one-piece blow bars of the prior art.

When manufacturing blow bars, it is desirable to maximize the tonnage of rock crushed with one blow bar. The life of the blow bar may be increased, and thereby increase the tonnage of crushed rock per blow bar, by increasing the life of the wear tip. In use, the wear tip becomes worn along the leading edge, denoted at 143, because it is leading edge 134 which has primary exposure to the rock being crushed against the apron (not shown).

To extend the life of the wear tip, the blow bar may be used until the leading edge of the wear tip becomes worn. The wear tip may then be removed from the carrier bar and rotated 180 degrees about the transverse direction (arrow C) and reattached to the carrier bar. Thus, edge 136 becomes the leading edge and the effective life of the wear tip is approximately doubled.

From the foregoing, it will be appreciated that the present invention provides methods and apparatus for providing surfaces for use in high impact applications such as in ore comminution. For example, the present invention may be implemented to provide a liner for use in protecting the shell of an ore grinding mill which can be easily and inexpensively attached to and removed from the mill shell. The unique mounting apparatus employed by the present invention enable through holes to be eliminated from the liner segments and permits the liner segments to quickly be mounted to the shell of the mill while avoiding the mounting problems which typically arise when through holes are eliminated.

The present invention also provides a liner design which may be cast and heat treated such that the microstructure of the liner may be controlled, thereby producing a liner having substantially the same microstructure throughout the liner. The laminar construction of the present invention minimizes the temperature gradients which occur upon cooling in other liner designs, which temperature gradients prevent certain microstructures from being achieved throughout the liner. The minimized temperature gradients also effectively reduce the risk that the laminae which comprise the liner segment will crack during the heat treating process. Thus, the liners of the present invention have substantially the same degree of hardness and toughness throughout the liner and the amount of hardness and toughness may be controlled during the manufacturing process.

The liners of the present invention may be mounted to the shell of the mill in such a way that through holes in the wear zone of the liner are eliminated, thereby eliminating the weak area which accompanies the existence of such holes. The two-piece liner bolt design used in mounting the liner segments of the present invention enable the through holes to be eliminated while not unduly complicating the mounting process because of their removal.

In addition to the use of the present invention in providing a liner for a mill shell, the present invention is also described for use as a wear tip on a blow bar for a rock impact crusher. The laminar assembly of the present invention permits a blow bar to be manufactured with superior metallurgical properties than heretofore available in blow bars while employing a mounting mechanism which enables the wear tip to be quickly and easily mounted or removed.

It will be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A laminar segment for use as an impact surface in comminution equipment, comprising:

a plurality of laminae configured such that the laminae may be associated together to form an integral segment, each lamina having opposing faces, and a core, and being configured such that a distance from the center of the core in the axial direction to a face of the lamina is less than a distance from the center of the core to a surface of the laminae in the radial or transverse direction;

means for combining the plurality of laminae to form an integral segment; and means for attaching the integral segment to the comminution equipment.

2. A laminar segment for use as an impact surface in comminution equipment as defined in claim 1, wherein the means for combining the plurality of laminae includes means for applying compressive forces to the plurality of laminae to form an integral segment.

3. A laminar segment for use as an impact surface in comminution equipment as defined in claim 1, wherein the means for combining the plurality of laminae comprises a high-strength rod which extends substantially the entire length of the integral segment in the axial direction.

4. A laminar segment for use as an impact surface in comminution equipment as defined in claim 3, wherein the rod engages each of the laminae.

5. A laminar segment for use as an impact surface in comminution equipment as defined in claim 3, wherein the means for attaching the integral segment to the comminution equipment comprises a plurality of attachment mechanisms which are attached to the rod.

6. A laminar segment for use as an impact surface in comminution equipment as defined in claim 5, wherein the comminution equipment is an ore grinding mill having a shell and the attachment mechanisms are configured to extend from the rod through the shell of the mill.

7. A laminar segment for use as an impact surface in comminution equipment as defined in claim 6, wherein the comminution equipment is a rock impact crusher having a carrier bar and the attachment mechanisms are configured to extend from the rod through the carrier bar such that the laminar segment may be mounted to the carrier bar.

8. A laminar segment for use as an impact surface in comminution equipment as defined in claim 1, wherein the opposing faces of each lamina include a front face and a back face and the laminae are associated together such that the front faces of adjacent laminae are directed towards each other and the back faces of adjacent laminae are directed towards each other.

9. A laminar segment for use as an impact surface in comminution equipment as defined in claim 8, wherein the front face and the back face of the laminae are perpendicular to a line in the axial direction.

10. A laminar segment for use as an impact surface in comminution equipment as defined in claim 1, further comprising means for preventing relative movement of the laminae.

11. A laminar segment for use as an impact surface in comminution equipment as defined in claim 10, wherein the means for preventing relative movement cf the laminae includes a recess configured in one lamina and a corresponding tab configured in an adjacent lamina such that the recess and the tab engage when the laminae are combined to form the integral segment.

12. A laminar segment for use as an impact surface in comminution equipment as defined in claim 1, wherein the plurality of laminae comprise a first plurality of laminae and further comprising a second plurality of laminae and means for attaching the first plurality of laminae to the second plurality of laminae.

13. A laminar segment for use as an impact surface in comminution equipment as defined in claim 12, wherein the means for attaching the first plurality of laminae to the second plurality of laminae comprises a first high-strength rod which extends substantially the entire length of the integral segment in the axial direction.

14. A laminar segment for use as an impact surface in comminution equipment as defined in claim 13, wherein the means for attaching the integral segment to the comminution equipment comprises a second high-strength rod which extends substantially the entire length of the integral segment in the axial direction, the second rod having a head and a nut.

15. A laminar segment for use as an impact surface in comminution equipment as defined in claim 14, wherein the means for attaching the integral segment to the comminution equipment further comprises a plurality of mounting bolts and a stud anchor corresponding to each mounting bolt, each stud anchor having an axial hole which engages the second high-strength rod and being configured for engagement with the corresponding mounting bolt.

16. A laminar segment for use as an impact surface in comminution equipment as defined in claim 15, wherein the second plurality of laminae includes internal laminae configured with an axial hole for engagement with the first high-strength rod and end-and-stud laminae configured with a mounting channel.

17. A laminar segment for use as an impact surface in comminution equipment as defined in claim 16, wherein the mounting channel is configured such that a pocket for receiving a stud anchor may be formed when two internal laminae are placed in adjacent connection.

18. A laminar segment for use as an impact surface in comminution equipment as defined in claim 17, wherein the laminar segment has two ends and an end-and-stud lamina is employed at each end and oriented such that the head and nut on the second rod rest within the mounting channels of the end-and-stud laminae.

19. A laminar assembly for use as an impact surface in comminution equipment, comprising:

a plurality of integral metal laminae having a core and a surface, each of which has been heat treated for hardness, each lamina being dimensioned such that upon heat treating the core microstructure is substantially equivalent to the surface microstructure; and means for attaching the integral laminae to the comminution equipment.

20. A laminar assembly for use as an impact surface in comminution equipment as defined in claim 19, wherein the microstructure is a martensitic microstructure.

21. A laminar assembly for use as an impact surface in comminution equipment as defined in claim 20, wherein the laminae are made of iron having a carbon content greater than approximately 1.25 percent.

22. A laminar assembly for use as an impact surface in comminution equipment as defined in claim 21, wherein the iron is a high-chromium, white iron.

23. A laminar assembly for use as an impact surface in comminution equipment as defined in claim 20, wherein the laminae are made of a steel having a carbon content between about 0.3 percent and about 0.7 percent.

24. Individually sized segments for attachment to a mounting surface of comminution equipment, comprising:

a plurality of laminae configured to mate into an integral laminar assembly prior to attachment to the comminution equipment;

a connector engaging each of a predetermined number of essentially identical laminae such that the laminar assembly is secured integrally together by the connector in any one of a plurality of axial lengths; and means for attaching the integral laminar assembly to the mounting surface of the comminution equipment.

25. Individually sized segments for attachment to a mounting surface of comminution equipment as defined in claim 24, wherein the connector is configured to engage the laminae such that the laminae are placed in compression.

26. Individually sized segments for attachment to a mounting surface of comminution equipment as defined in claim 24, wherein the connector comprises a high-strength rod and wherein each lamina includes a base and a wear section and the base is configured with a hole extending in an axial direction through which the rod is connected to the laminae.

27. Individually sized segments for attachment to a mounting surface of comminution equipment as defined in claim 26, wherein the means for attaching the integral laminar assembly to the mounting surface of the comminution equipment includes a plurality of attachment mechanisms in connection with the rod.

28. Individually sized segments for attachment to a mounting surface of comminution equipment as defined in claim 27, wherein each attachment mechanism includes a head, the head being configured with a hole extending therethrough through which the rod is connected to the attachment mechanisms.

29. Individually sized segments for attachment to a mounting surface of comminution equipment as defined in claim 28, wherein the laminae are configured such that a pocket is configured in the base of adjacent laminae for receiving the head of the attachment mechanism.

30. An attachment mechanism for mounting a laminar segment to a mounting surface of a piece of comminution equipment comprising:

a laminar segment; and a plurality of bolts attached to the laminar segment, wherein the laminar segment includes a plurality of laminae with a pocket formed between selected adjacent laminae and the first end of the attachment mechanism comprises a stud anchor which is configured to fit within the pocket.

31. An attachment mechanism for mounting a laminar segment to a mounting surface of a piece of comminution equipment as defined in claim 30, wherein the stud anchor is configured such that it does not protrude from the laminar segment.

32. An attachment mechanism for mounting a laminar segment to a mounting surface of a piece of comminution equipment as defined in claim 30, wherein the stud anchor is configured with an axial hole extending therethrough through which a rod may be placed such that the stud anchor may be attached to the laminar segment.

33. An attachment mechanism for mounting a laminar segment to a mounting surface of a piece of comminution equipment as defined in claim 30, wherein the second end of the bolt is configured to extend from the stud anchor through the mounting surface of the comminution equipment.

34. An attachment mechanism for mounting a laminar segment to a mounting surface of a piece of comminution equipment as defined in claim 33, wherein the second end of the bolt comprises a threaded rod.

35. An attachment mechanism for mounting a laminar segment to a mounting surface of a piece of comminution equipment as defined in claim 33, wherein the second end of the bolt comprises a cap screw.

36. An attachment mechanism for mounting a laminar segment to a mounting surface of a piece of comminution equipment as defined in claim 30, wherein the means for attaching the first end to the second end comprises a threaded female member on the first end and a threaded male member on the second end, the threaded female and male member configured to threadably engage each other.

* * * * *